US008325062B2

(12) United States Patent
Johnson

(10) Patent No.: US 8,325,062 B2
(45) Date of Patent: Dec. 4, 2012

(54) CENTRALIZED MANAGEMENT OF PREEMPTION CONTROL OF TRAFFIC SIGNALS

(75) Inventor: David Randal Johnson, Oakdale, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 521 days.

(21) Appl. No.: 12/576,623

(22) Filed: Oct. 9, 2009

(65) Prior Publication Data

US 2011/0084853 A1 Apr. 14, 2011

(51) Int. Cl.
*G08G 1/08* (2006.01)

(52) U.S. Cl. ..... 340/909; 340/906; 340/916; 340/924

(58) Field of Classification Search ..... 340/909, 340/910, 916, 917, 919, 924, 906, 907; 701/300, 701/301

See application file for complete search history.

(56) References Cited

U.S. PATENT DOCUMENTS

| | | | | |
|---|---|---|---|---|
| 4,573,049 | A * | 2/1986 | Obeck | 340/924 |
| 5,172,113 | A * | 12/1992 | Hamer | 340/907 |
| 5,187,476 | A | 2/1993 | Hamer | |
| 5,202,683 | A | 4/1993 | Hamer et al. | |
| 5,539,398 | A | 7/1996 | Hall et al. | |
| 5,602,739 | A | 2/1997 | Haagenstad et al. | |
| 6,064,319 | A | 5/2000 | Matta | |
| 6,621,420 | B1 | 9/2003 | Poursartip | |
| 6,985,090 | B2 | 1/2006 | Ebner et al. | |
| 7,307,547 | B2 | 12/2007 | Schwartz | |
| 7,333,028 | B2 | 2/2008 | Schwartz | |
| 7,417,560 | B2 | 8/2008 | Schwartz | |
| 7,515,064 | B2 | 4/2009 | Schwartz | |
| 2005/0264431 | A1 | 12/2005 | Bachelder | |
| 2007/0001871 | A1 * | 1/2007 | Pfleging et al. | 340/907 |
| 2010/0321207 | A1 * | 12/2010 | Etchegoyen | 340/906 |

FOREIGN PATENT DOCUMENTS

| | | |
|---|---|---|
| DE | 198 42 912 | 3/2000 |
| WO | 2005/094544 | 10/2005 |

* cited by examiner

*Primary Examiner* — Thomas Mullen
(74) *Attorney, Agent, or Firm* — Crawford Maunu PLLC

(57) ABSTRACT

Managing traffic signal preemption at a plurality of intersections. In one approach a security level code that specifies one of a plurality of security levels for at least one jurisdiction is input. The security level controls which emitter codes are allowed to preempt traffic signals at the intersections in the jurisdiction. A set of emitter codes for the plurality of intersections in the jurisdiction is determined in response to the security level code. The set of emitter codes is downloaded to a plurality of preemption controllers at the plurality of intersections in the jurisdiction. Each preemption controller accepts a preemption request only if the preemption request contains an emitter code indicated by the downloaded set of emitter codes as being allowed to preempt traffic signals at the intersections in the jurisdiction.

21 Claims, 12 Drawing Sheets

CENTRALIZED MANAGEMENT OF PREEMPTION CONTROL OF TRAFFIC SIGNALS

FIELD OF THE INVENTION

The present invention is generally directed to traffic control preemption systems.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulse received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM®GPS priority control system. This system utilizes a GPS receiver in the vehicle to determine location, speed and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and, therefore, a preemption candidate. Preemption candidates with valid security codes are reviewed with other detected vehicles to determine the highest priority vehicle. Vehicles of equivalent priority are generally selected in a first come, first served manner. A preemption request is issued to the controller for the approach direction with the highest priority vehicle travelling on it.

With metropolitan wide networks becoming more prevalent, additional means for detecting vehicles via wired networks such as Ethernet or fiber optics and wireless networks such as Mesh or 802.11b/g may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed and heading along with the current time on the vehicle. Intersections on the network receive the vehicle information and evaluate the position using approach maps as described in the Opticom GPS system. The security coding could be identical to the OPTICOM®GPS system or employ another coding scheme.

SUMMARY

The various embodiments of the invention provide various approaches for managing traffic signal control preemption at a plurality of intersections.

In one embodiment of the invention, a method is provided for managing traffic signal preemption at a plurality of intersections. A user inputs a security level code that specifies one of a plurality of security levels for at least one jurisdiction. The security level controls which emitter codes will be allowed to preempt traffic signals at the intersections in the jurisdiction.

A set of emitter codes are then determined for the plurality of intersections in the jurisdiction in response to the security level code setting. Once the set of emitter codes are determined, the set of codes are downloaded to a plurality of preemption controllers at the plurality of intersections in the jurisdiction. Each preemption controller accepts a preemption request only if the preemption request contains an emitter code indicated, by the downloaded set of emitter codes, as being allowed to preempt traffic signals at the intersections in the jurisdiction.

In another embodiment, a system is provided for managing traffic signal preemption at a plurality of intersections. The system includes: a processor, a common bus coupled to the processor, a memory unit coupled to the common bus, and an input/output unit coupled to a common bus.

The processor and memory are configured to receive a security level code input that specifies one of a plurality of security levels for at least one jurisdiction. The security level input received controls which emitter codes are allowed to preempt traffic signals at the plurality of intersections in the jurisdiction. The processor and memory are further configured to determine a set of emitter codes for the plurality of intersections in the jurisdiction in response to the security level code. The processor and memory are also configured to download the set of emitter codes to a plurality of preemption controllers at the plurality of intersections in the jurisdiction. Each preemption controller accepts a preemption request only if the preemption request contains an emitter code indicated by the downloaded set of emitter codes as being allowed to preempt traffic signals at the plurality of intersections in the jurisdiction.

In yet another embodiment, an article of manufacture is provided and is characterized by a processor-readable storage medium configured with processor-executable instructions. When the instructions are executed by a processor, the instructions cause the processor to receive a security level code input that specifies one of a plurality of security levels for at least one jurisdiction in response to user input. The security level input controls which emitter codes are allowed to preempt traffic signals at the plurality of intersections in the jurisdiction.

The readable storage medium is configured with further instructions for causing a processor to determine a set of emitter codes for the plurality of intersections in the jurisdiction in response to the security level code and downloading the set of emitter codes to a plurality of preemption controllers at the plurality of intersections in the jurisdiction. The instructions are configured such that each preemption controller accepts a preemption request only if the preemption request contains an emitter code indicated by the downloaded set of emitter codes as being allowed to preempt traffic signals at the plurality of intersections in the jurisdiction.

DETAILED DESCRIPTION

The embodiments of the present invention generally provide a method of centrally managing the traffic signal preemption controllers at multiple, geographically dispersed intersections. The preemption controllers within one or more jurisdictions within a region may be managed (configured and queried) as a group. Each traffic controller may also be managed individually if desired. Among other management tasks, the preemption controllers in a particular jurisdiction can be collectively configured to operate in a selected security mode that controls which vehicles (via their emitters) are allowed to preempt traffic control signals in that jurisdiction. As used herein, the term "emitter" refers to the various types of modules capable of communicating a preemption request to a preemption controller. This includes, for example, IR light based modules, GPS based modules, and wireless network based modules.

Figure 1:
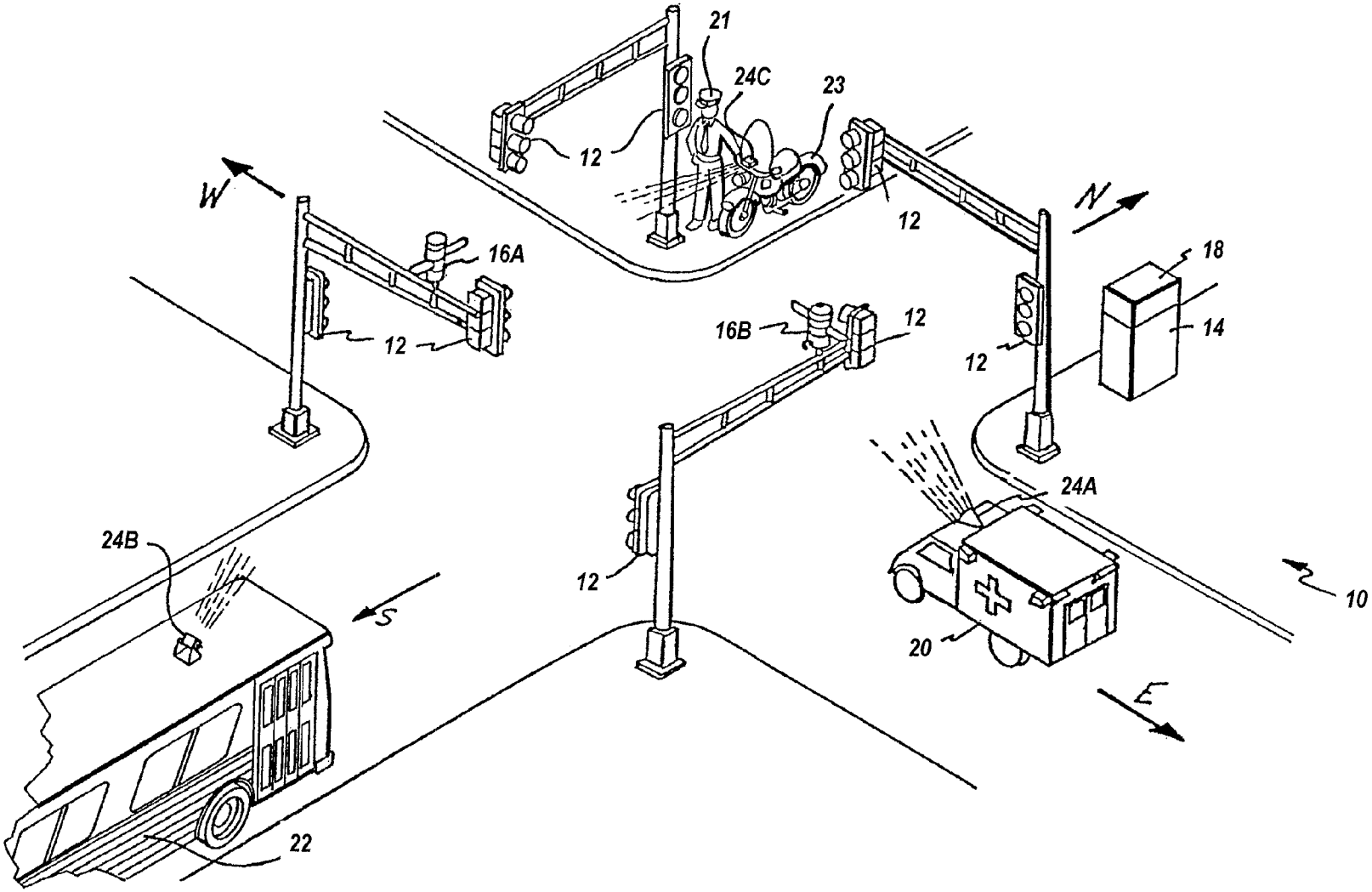
FIG. 1 is an illustration of a typical intersection having traffic signal lights and a traffic control preemption system.

FIG. 1 is an illustration of a typical intersection 10 having traffic signal lights 12. The equipment at the intersection illustrates the environment in which embodiments of the present invention may be used. A traffic signal controller 14 sequences the traffic signal lights 12 to allow traffic to proceed alternately through the intersection 10. The intersection 10 may be equipped with a traffic control preemption system such as the OPTICOM® Priority Control System.

The traffic control preemption system shown in FIG. 1 includes detector assemblies 16A and 16B, signal emitters 24A, 24B and 24C, a phase selector (not shown), a traffic signal controller 14, and a preemption controller 18. The detector assemblies 16A and 16B are stationed to detect signals emitted by authorized vehicles approaching the intersection 10. The detector assemblies 16A and 16B communicate with the phase selector, which is typically located in the same cabinet as the traffic controller 14.

In FIG. 1, an ambulance 20 and a bus 22 are approaching the intersection 10. The signal emitter 24A is mounted on the ambulance 20 and the signal emitter 24B is mounted on the bus 22. The signal emitters 24A and 24B each transmit a signal that is received by detector assemblies 16A and 16B. The detector assemblies 16A and 16B send output signals to the phase selector. The receiver circuit 18 processes the output signals from the detector assemblies 16A and 16B to determine the signal characteristics including: frequency, intensity, and security code of the signal waveform, or pulses. The security code, consisting of the vehicle class and vehicle identification is encoded in the signal by interleaving data pulses between the base frequency pulses. In GPS systems, location, speed, and heading of the vehicle are also determined and transmitted. If an acceptable frequency, intensity, and/or security code are observed the phase selector generates a preemption request to the traffic signal controller 14 to preempt a normal traffic signal sequence. The phase selector alternately issues preemption requests to and withdraws preemption requests from the traffic signal controller, and the traffic signal controller determines whether the preemption requests can be granted. The traffic signal controller may also receive preemption requests originating from other sources, such as a nearby railroad crossing, in which case the traffic signal controller may determine that the preemption request from the other source be granted before the preemption request from the phase selector. In some embodiments of the present invention the function of the phase selector is performed solely by the traffic controller.

The traffic controller determines the priority of each signal received and whether to preempt traffic control based on the security code contained in the signal. For example, the ambulance 20 may be given priority over the bus 22 since a human life may be at stake. Accordingly, the ambulance 20 would transmit a preemption request with a security code indicative of a high priority while the bus 20 would transmit a preemption request with a security code indicative of a low priority. The phase selector would discriminate between the low and high priority signals and request the traffic signal controller 14 to cause the traffic signal lights 12 controlling the ambulance's approach to the intersection to remain or become green and the traffic signal lights 12 controlling the bus's approach to the intersection to remain or become red.

Generally, a traffic controller must be preprogrammed to determine whether to preempt traffic control for a given security code and priority. Manual programming of traffic controllers can be labor intensive and expensive. The present invention provides several options for centralized control and configuration of preemption controllers.

The centrally managed preemption systems of the present invention provide a preemption controller 18 which can be updated from a centralized control apparatus with security codes authorized to preempt traffic control along with any associated priority. When the preemption controller receives a preemption request, the preemption controller determines whether the security code is authorized and the priority associated with the security code. Preemption candidates with valid security codes are reviewed with other detected vehicles to determine the highest priority vehicle. Vehicles of equivalent priority are generally selected in a first come, first served manner, but could be further differentiated by class of vehicle. A preemption request is issued to the controller for the approach direction with the highest priority vehicle travelling on it.

Figure 2:
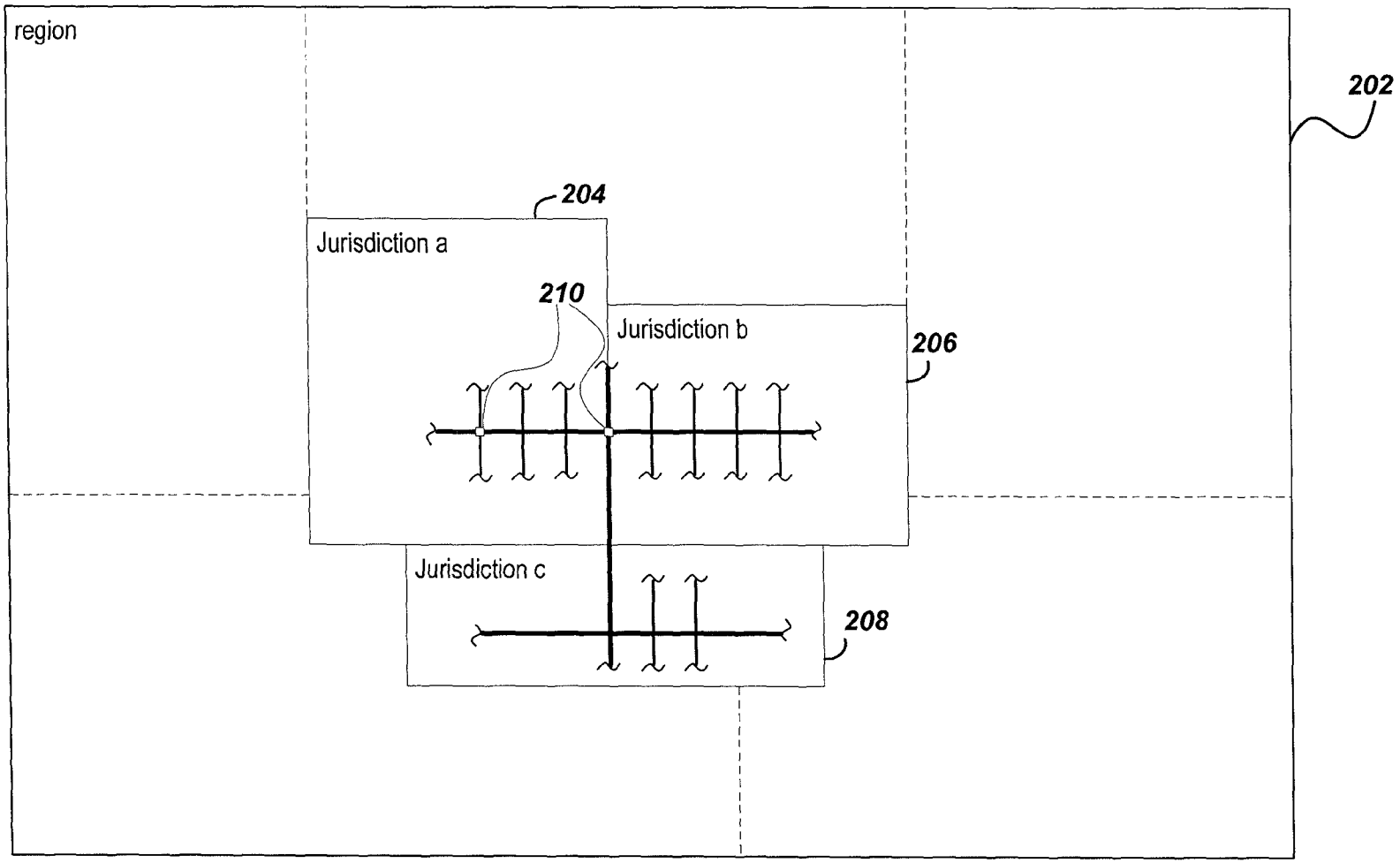
FIG. 2 shows the relationship between a region, multiple jurisdictions, and intersections of example roads within the jurisdictions.

FIG. 2 shows the relationship between a region, multiple jurisdictions, and intersections of example roads within the jurisdictions. Region 202 includes a plurality of jurisdictions, of which, example jurisdiction A 204, jurisdiction B 206, and jurisdiction C 208 are shown. A plurality of roads and intersections are shown in the jurisdictions with centrally controlled intersections 210 shown. Between two jurisdictions, roads may be shared, in that a road crosses between the two jurisdictions or marks the border between the jurisdictions. Alternatively a road may be wholly contained in a single one of the jurisdictions.

In some embodiments of the invention, the preemption controllers within each jurisdiction within a region may be managed (configured and queried) as a group. Preemption controllers may also be managed individually. Among other management tasks, the preemption controllers in a particular jurisdiction can be collectively configured to operate in a selected security mode that controls which vehicles (via their emitters and associated emitter identifiers) are allowed to preempt traffic control signals in that jurisdiction. In some embodiments of the invention, preemption controllers of particular intersections may also be centrally configured.

Figure 3:
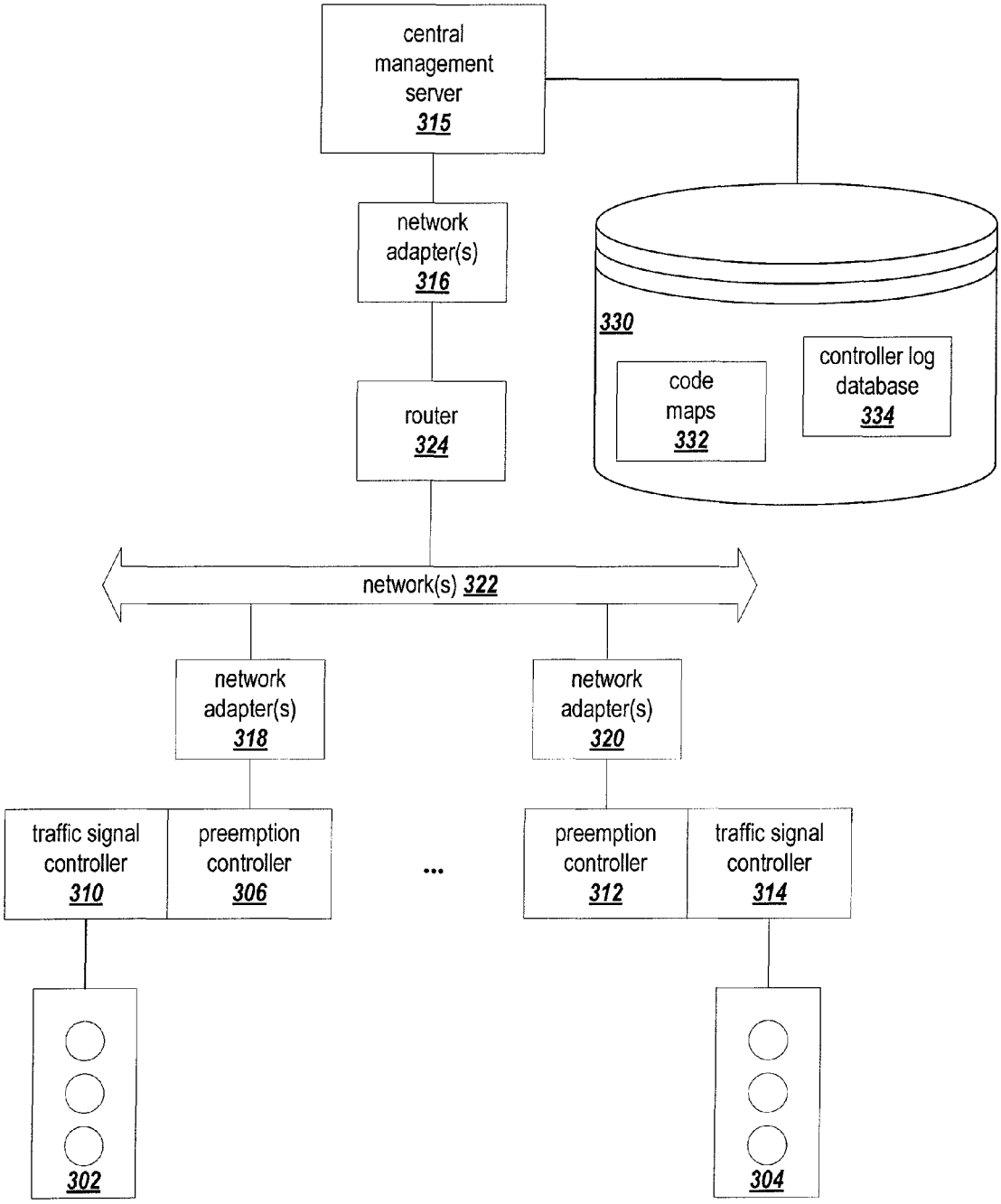
FIG. 3 is a block diagram, as an example, of a system for managing traffic signal preemption in accordance with several embodiments of the invention.

FIG. 3 is a block diagram, as an example, of a system for managing traffic signal preemption in accordance with several embodiments of the invention. Traffic lights 302 and 304 at intersections with preemption controllers are coupled to traffic signal controllers 310 and 314, respectively. Traffic signal controllers 310 and 314 are connected to respective preemption controllers 306 and 312. A central management server 315 and the preemption controllers are respectively coupled to network adapters 316, 318, and 320 for communication over a network 322. In various embodiments, a router or a network switch, as shown by router 324, may be coupled between the network adapter and the network. It is understood the central management server 315 and the preemption controllers 306 and 312 may be connected through more than one networks, coupled by additional switches and routing resources, including a connection over the internet.

The central management server 315 is additionally coupled to a database server 330. Code maps 332 contain respective sets of codes for the jurisdictions managed by the central management server 315 and are stored on server 330. A controller log database 334 is also stored on server 330. It is understood that file server 330 may comprise several local and/or remote servers.

In various embodiments of the present invention, configuration of the geographically dispersed preemption controllers may be accomplished by a single administrator working from the central management server. The administrator is provided with the ability to specify at the jurisdiction level those vehicles that are authorized to preempt traffic signals within the jurisdictions. Some embodiments refer to the administrator as a systems administrator or a user and such terms are used interchangeably herein.

Configuration and/or data retrieval is accomplished by the central management server establishing a connection with a preemption controller. Once a connection is established, the preemption controller can be configured by downloading security codes onto the preemption controller. During the connection, controller logs of preemption activity maintained by the preemption controller can be uploaded to the central management server 315. The uploaded logs are then stored in the controller log database 334. In some embodiments, the connection for configuration and/or data retrieval is initiated and established by the central management server 315.

It is understood that numerous network transfer protocols may be used to establish, maintain, and route connections including: TCP/IP, UDP, NFS, ESP, SPX, etc. It is also understood that network transfer protocols may utilize one or more lower layers of protocol communication such as ATM, X.25, or MTP, and on various physical and wireless networks such as, Ethernet, ISDN, ADSL, SONET, IEEE 802.11, V.90/v92 analog transmission, etc.

Figure 4:
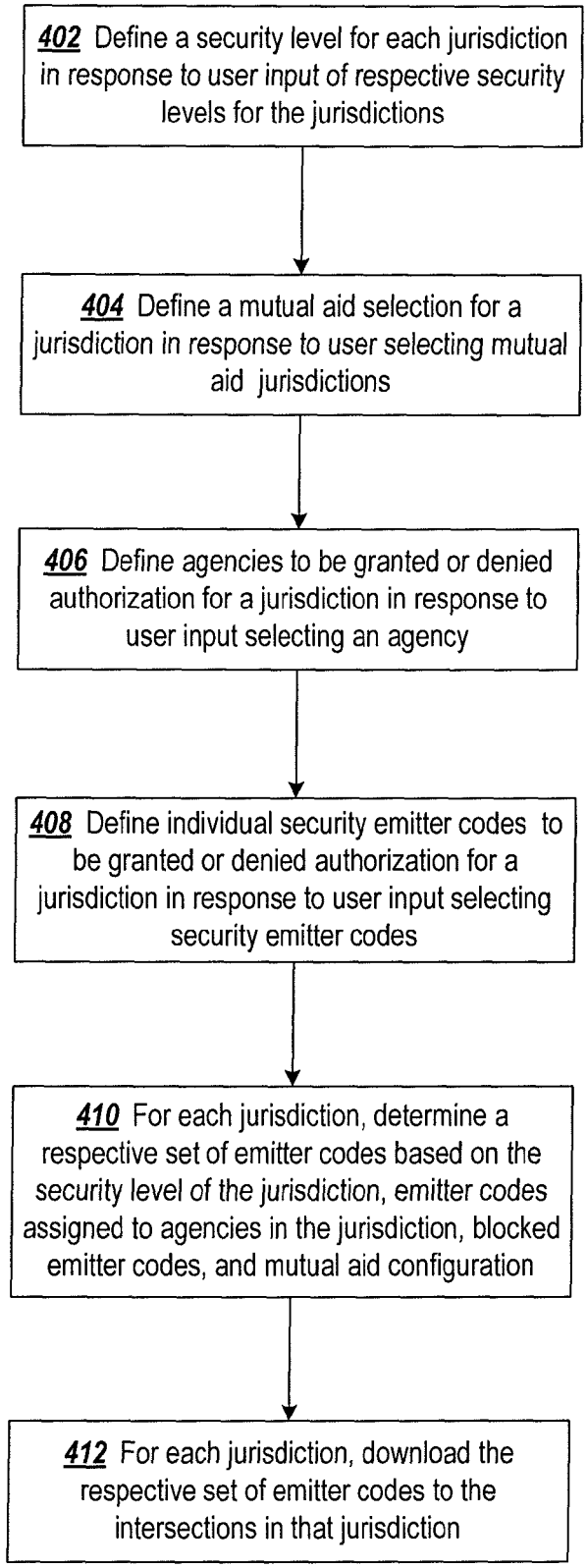
FIG. 4 is a flowchart of an example process for managing traffic signal preemption in accordance with several embodiments of the invention.

FIG. 4 is a flowchart of an example process for managing traffic signal preemption in accordance with several embodiments of the invention. A security level is defined or updated for one or more jurisdictions to be managed at step 402 in response to user input. For each jurisdiction, the security level settings of each jurisdiction defined at step 402 may be optionally supplemented by granting or denying preemption authorization to vehicles from other jurisdictions, selected agencies, and individual emitter codes. Mutual aid jurisdiction settings may be optionally defined for a jurisdiction in response to user input selecting a jurisdiction for mutual aid at step 404.

A particular agency to be granted or denied preemption authorization is defined at step 406 in response to user input which specifies that agency. Individual emitter identification codes to be granted or denied authorization may be separately defined by the user at step 408.

For each jurisdiction that the security level is defined, a respective set of emitter codes is generated at step 410 based on: the security level defined in step 402, any mutual aid settings defined in step 404, any agency settings defined in step 406, and any individual emitter security code setting defined in step 408.

For each jurisdiction defined or updated at steps 402, 404, 406, or 408, the respective set of emitter codes generated at step 410 is downloaded to the preemption controllers of intersections of the jurisdiction at step 412.

In another embodiment, security settings, mutual aid settings, agency settings, and emitter code settings may be defined for individual intersections within each jurisdiction. Still other embodiments allow these settings to be defined for individual preemption controllers located at a particular intersection. The configuration of individual preemption controllers at an intersection may be useful when different priority or access is desired for different directions of traffic approaching the intersection.

Figure 5:
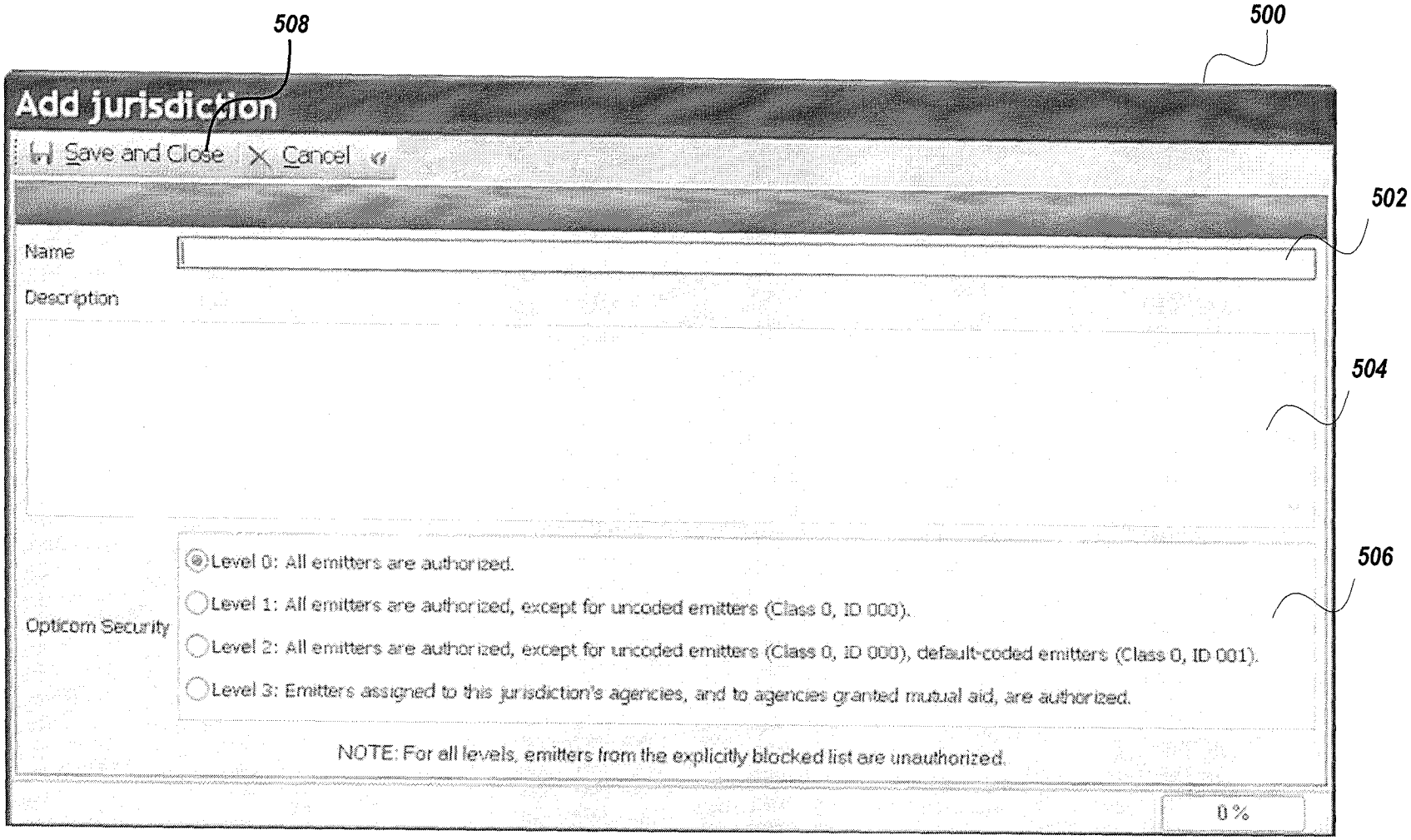
FIG. 5 illustrates, as an example, a user interface screen for defining the security level of a newly added jurisdiction in accordance with several embodiments of the invention.

FIG. 5 illustrates, as an example, a user interface screen 500 for defining the security level of a newly added jurisdiction in accordance with several embodiments of the invention. The jurisdiction name is defined by the user typing a name in name field 502. A description of the jurisdiction can be defined by typing the description in description field 504.

In this embodiment, there are four security settings available in security level field 506: level 0, in which all emitter codes are authorized; level 1, in which all emitter codes are authorized except for uncoded emitters; level 2, in which all emitter codes are authorized except for uncoded emitters and default emitter codes; and level 3, in which only emitter codes assigned to the jurisdiction and jurisdictions or agencies granted mutual aid are authorized. Uncoded emitters are those that do not emit a coded signal. Default emitter codes are emitted from emitters that have not been configured with a particular identifier code. For example, in one implementation, emitter code 0 can be used to represent uncoded emitters, and emitter code 1 is the default code.

Some embodiments of the invention include additional security levels. For example, one additional security level may deny preemption authorization to agencies within the jurisdiction unless the agency is specifically authorized. Another example additional security level may deny preemption authorization to vehicles of mutual aid agencies unless specifically authorized. Another security level may authorize preemption only for emitter codes that have been assigned to specific vehicles of an agency. That is, a range of codes may be assigned to an agency, and some of those codes may not be assigned to vehicles within the agency. For those unassigned emitter codes, preemption is denied.

Various embodiments of the invention utilize a similar interface to that in FIG. 5 for editing the name, description, and/or security level of a jurisdiction. A defined jurisdiction is edited by selecting the jurisdiction from a displayed list. The user interface screen of FIG. 5 is then displayed with saved data filling the fields. The data can be edited in the field and saved by selecting save and close button 508. Some other various embodiments of the invention also use a similar user interface to define and/or edit the security level of individual agencies and/or vehicles.

When a level is selected, the security level will become the default rule that may be supplemented by additional rules in accordance with some embodiments of the invention. For example, if security level 0 is selected, all emitter codes will be authorized as the default rule. However, if an administrator defines additional rules to restrict authorization from a particular jurisdiction, agency, or set of security emitter codes, in accordance with some embodiments of the invention, the additional defined rules will supplement the default rule defined by the security level.

Figure 6:
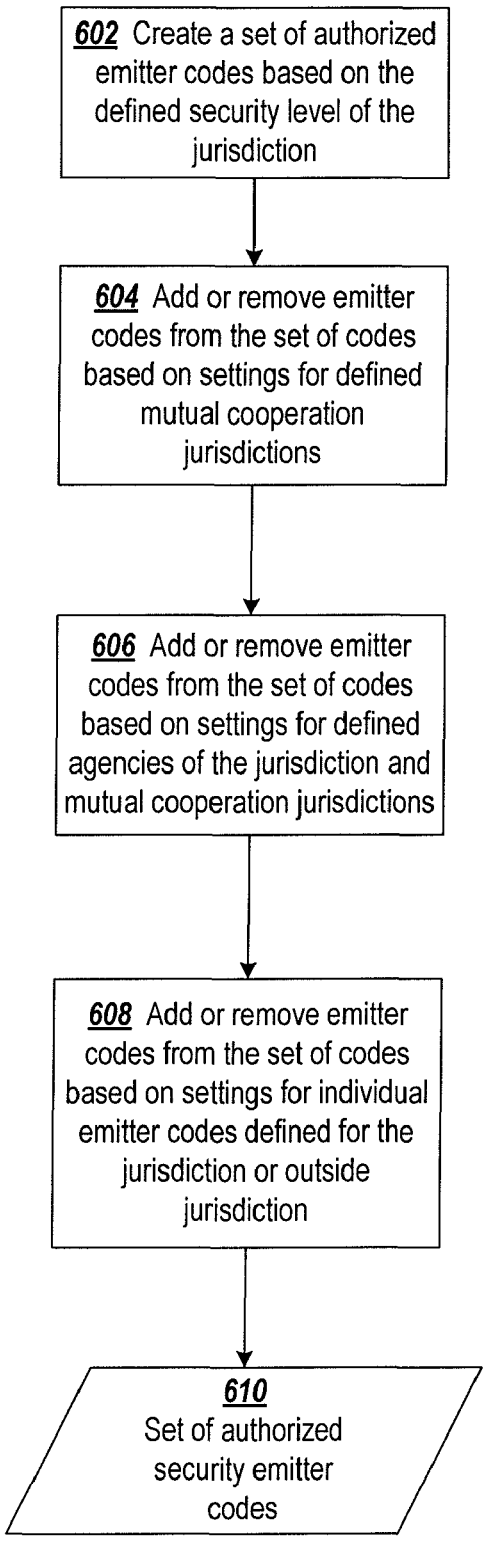
FIG. 6 illustrates a flowchart of an example process for creating a set of authorized emitter codes based on rules defined by a systems administrator.

FIG. 6 illustrates a flowchart of an example process for creating a set of authorized emitter codes based on the rules defined by the administrator for the jurisdiction or intersection to be configured. A set of emitter codes is created at step 602 based on the security level defined by the user for the jurisdiction, individual intersection, or preemption controller to be configured. The created set is modified at step 604 by adding or removing emitter codes based on settings for those jurisdictions specified as providing mutual aid. For example, a second jurisdiction may be selected for mutual aid and emitter codes of the second jurisdiction would be added to the set at step 604. At step 606, for agencies of the first jurisdiction and mutual cooperation jurisdictions specified as being authorized, such as a law enforcement authority, then emitter codes associated with those agencies are added to the set of emitter codes.

The set may be further modified at step 608 by adding or removing individual emitter codes selected by the user for emitters defined within or outside the jurisdiction. The set of authorization codes 610 can then be downloaded to the preemption controller(s).

It is understood that the emitter codes in the created set may be implemented in several ways and may include additional features. The example process in FIG. 6 creates a list of authorized security emitter codes. In some embodiments of the invention, a set of security emitter codes to be denied access may be created. Likewise, the set created may include a mix of security emitter codes granted access and denied access.

Further, to increase the level of control, some embodiments of the present invention will create a list including high level codes such as agency identifiers and or vehicle class identifiers to be granted or denied access. Use of higher level codes is useful when GPS priority control systems are employed that include this information in the transmitted security emitter codes.

Additionally, in some embodiments of the invention, security emitter code entries in the created set may include a priority setting associated with each security emitter code. The priority is used to determine how and whether to preempt traffic control when multiple vehicles with valid security codes and a sufficient intensity level are detected. Traffic control is preempted for vehicles with the highest priority. Vehicles of equivalent priority are selected in a first come, first served manner. A preemption request is issued to the controller for the approach direction with the highest priority vehicle travelling on it.

Figure 7:
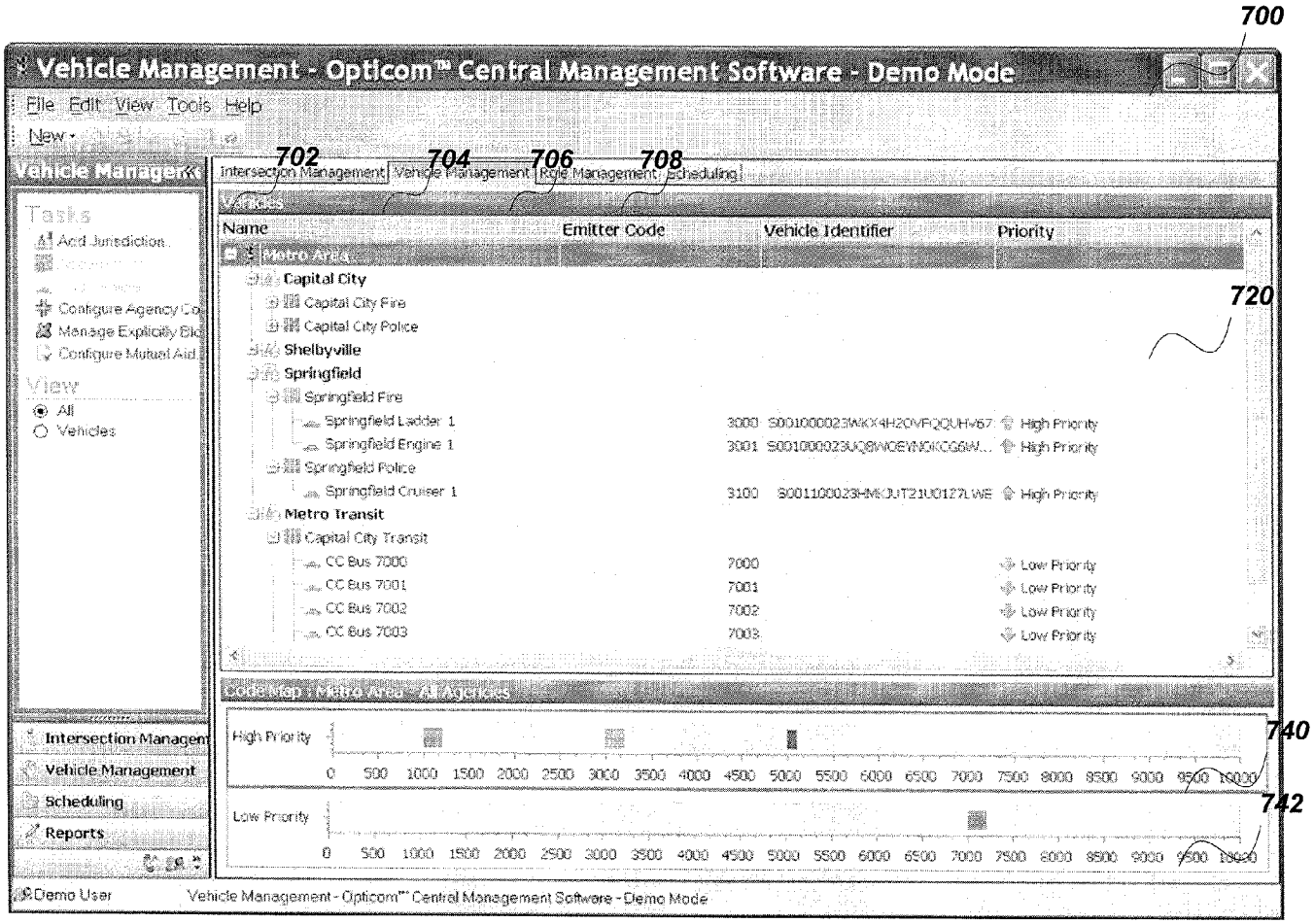
FIG. 7 shows, as an example, a user interface screen for editing individual emitter codes for vehicles which are controlled by various agencies within different jurisdictions.

FIG. 7 shows, as an example, a user interface screen for editing individual emitter codes for vehicles which are controlled by various agencies within different jurisdictions. User interface 700 contains several window tabs for: display and management of intersections 702; display and management of vehicles 704; role management 706; and scheduling update and configuration jobs 708. When tab 704 for display and management of vehicles is selected, window pane 720 showing the jurisdictions and vehicles of the region is displayed. An administrator can browse the hierarchy of jurisdictions, agencies, and vehicles by expanding jurisdictions and agencies listed on the left. For listed vehicles, the emitter code, vehicle identifier (if available), and the priority setting are displayed. Vehicles settings can be edited by selecting a vehicle and right clicking on the field to be edited. A code map of currently defined security emitter codes is also displayed in window pane 740 and 742. Ranges of security emitter codes assigned to a high priority are shown in pane 740 and ranges assigned to a low priority are shown in pane 742.

Figure 8:
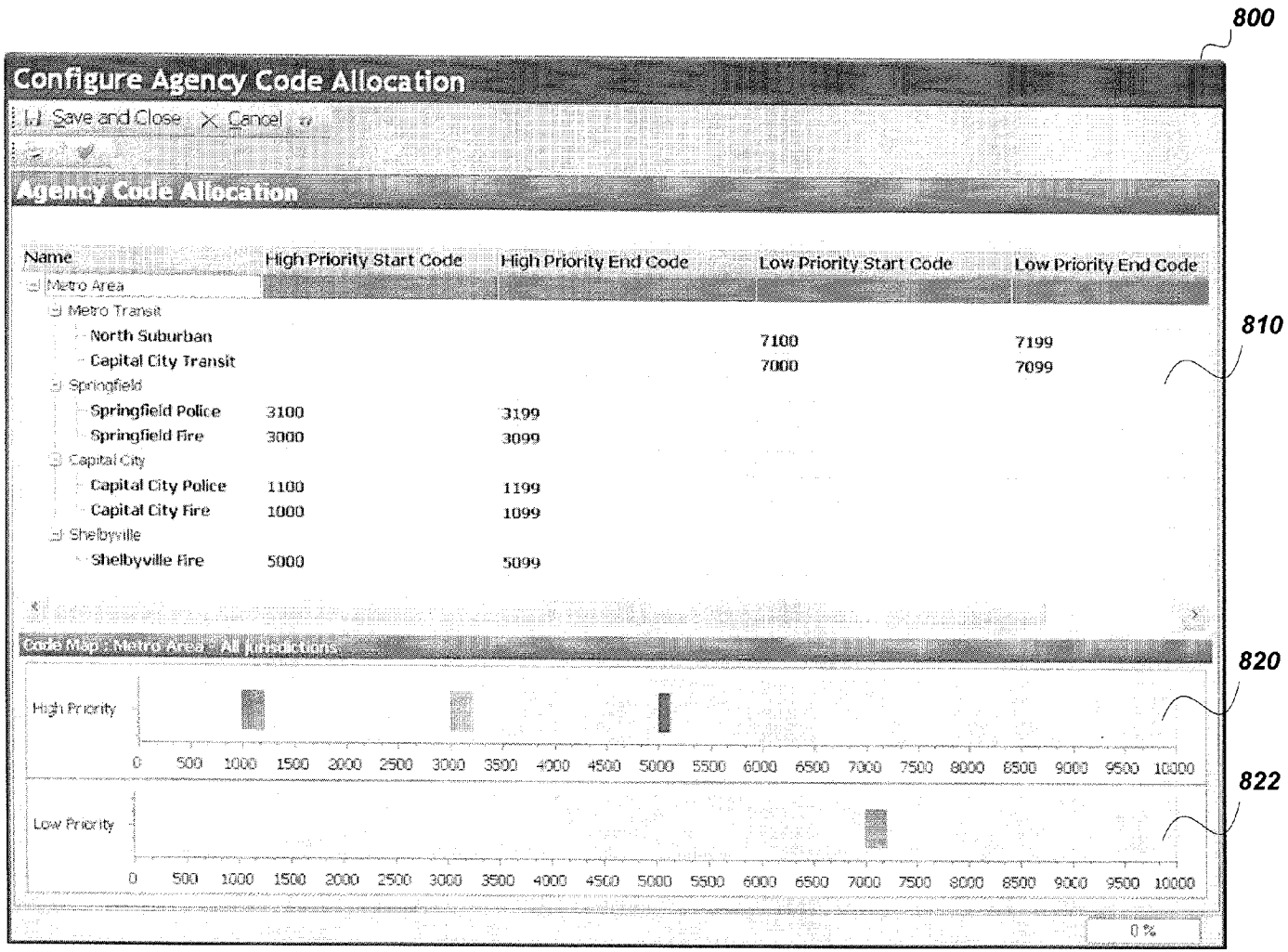
FIG. 8 shows, as an example, a user interface screen for editing the allocation of emitter codes between different jurisdictions and the agencies under those jurisdictions.

FIG. 8 shows, as an example, a user interface screen for editing the allocation of emitter codes between different jurisdictions and the agencies under those jurisdictions. User interface window 800 contains a window pane 810 which displays a hierarchy of jurisdictions and agencies within the current region. An administrator can browse the hierarchy of jurisdictions and agencies by expanding jurisdictions listed on the left. For each listed agency, a range of high priority emitter codes and a range of low priority emitter codes are shown. The range of emitter codes can be edited by selecting an agency and right clicking on the field to be edited. A code map of currently defined security emitter codes is also displayed in window pane 820 and 822 for reference. Security emitter codes assigned to a high priority are shown in pane 820 and security emitter codes assigned to a low priority are shown in pane 822.

Figure 9:
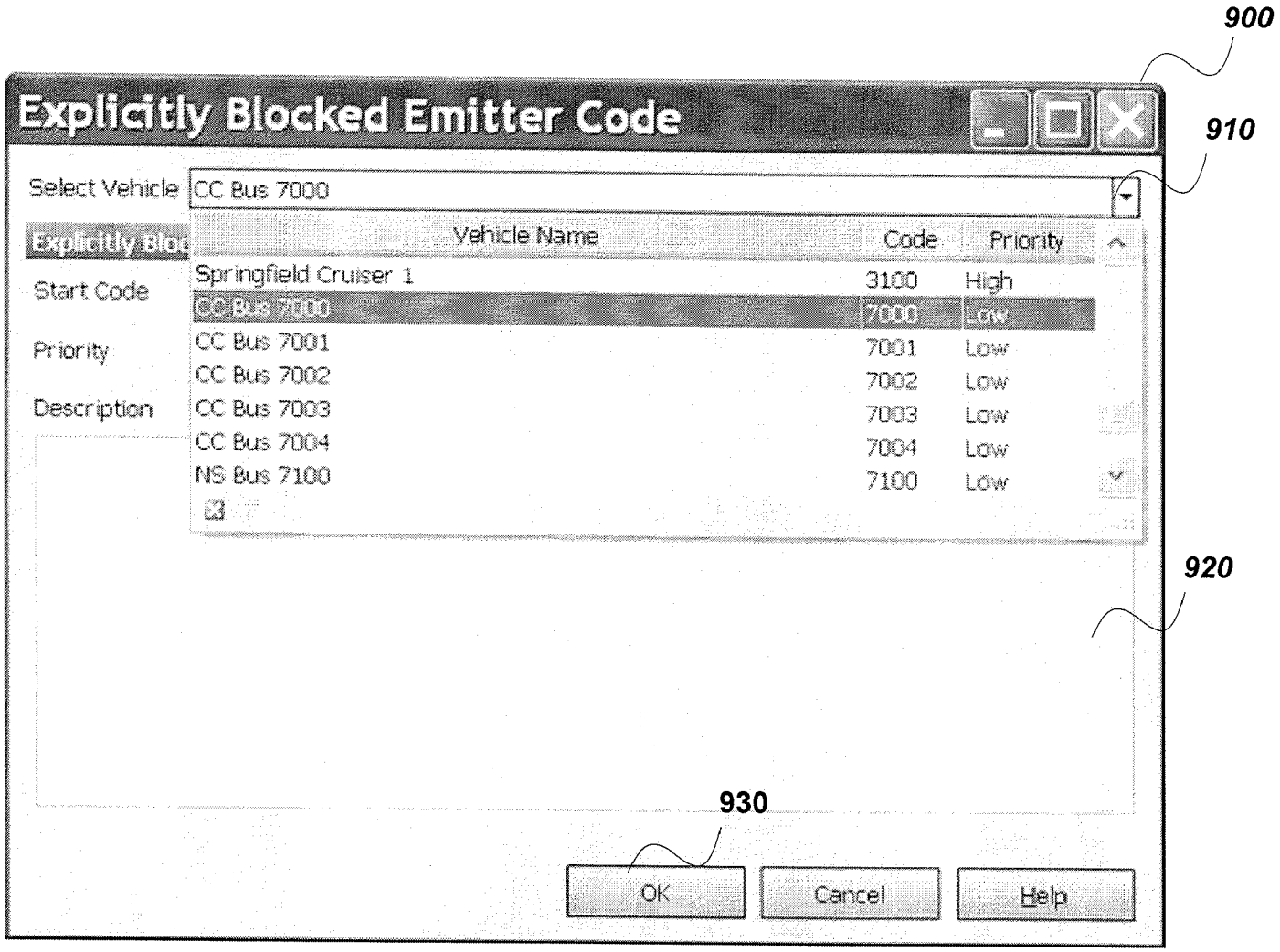
FIG. 9 shows, as an example, a user interface screen for editing explicitly blocked emitter codes.

FIG. 9 shows, as an example, a user interface screen for editing explicitly blocked emitter codes. From user interface screen 900, an individual emitter code, or a range of emitter codes (not shown), may be configured to be blocked by the preemption controllers in a jurisdiction. An administrator may select a vehicle from a drop down list 910 that shows vehicle names and associated emitter codes. Once a vehicle is selected, description information will be displayed in window pane 920 indicating the emitter code associated with the selected vehicle is blocked. If the code to be blocked is not associated with a vehicle in the database, then the user may select either a single code or a range of codes. In some embodiments, a priority level may be selected to be blocked within a selected range of codes. The information is stored in response to the administrator clicking OK button 930.

In some embodiments of the invention, several different sub-priority levels may exist. For example, priority levels A, B, C, and D may indicate a low priority while priority levels E, F, and G may indicate a high priority. In some embodiments, sub-priorities may be used to further determine priority between sub-priorities within the same priority class.

Figure 10:
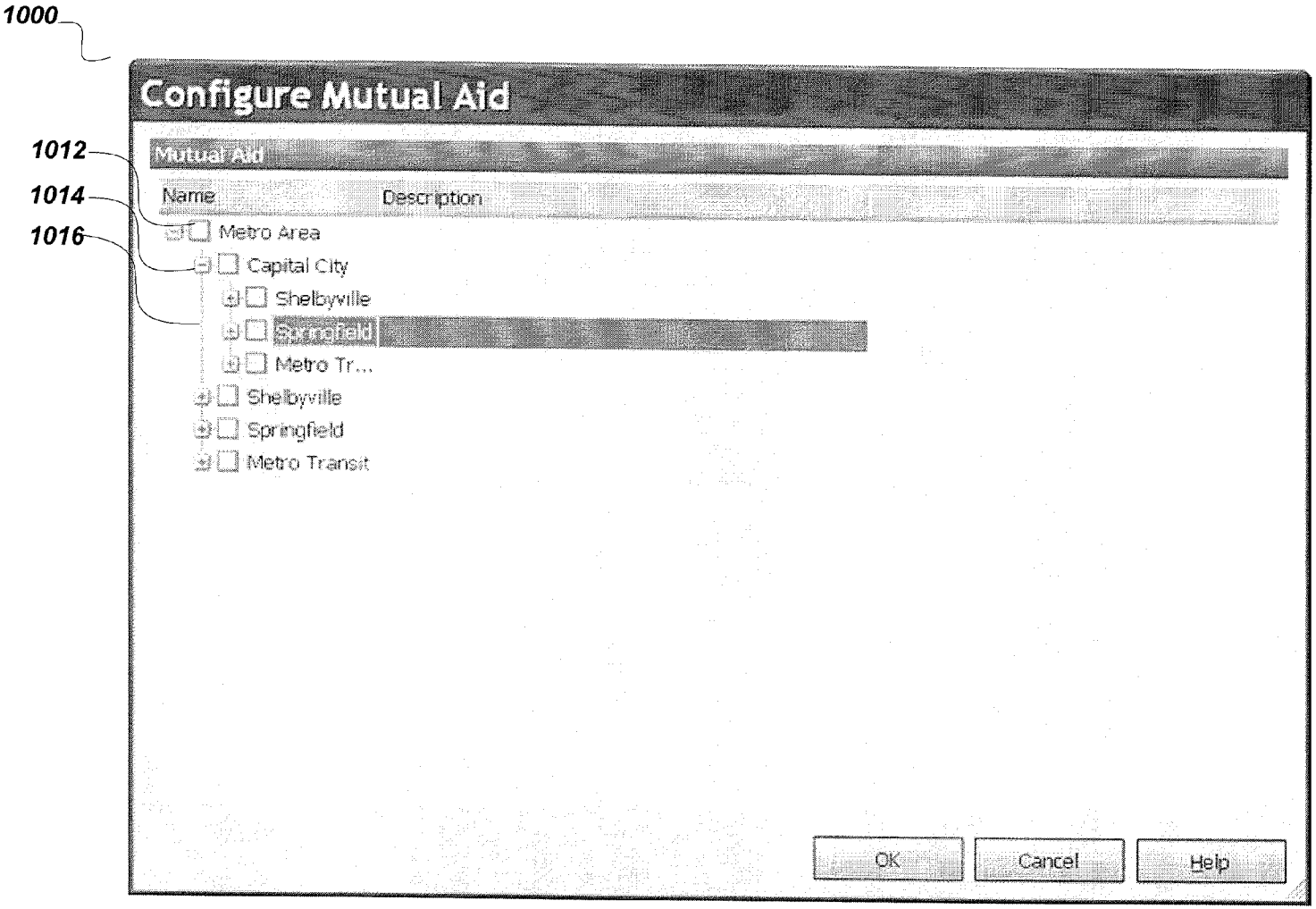
FIG. 10 shows, as an example, a user interface screen for configuring mutual aid between jurisdictions.

FIG. 10 shows, as an example, a user interface screen for configuring mutual aid between jurisdictions. User interface 1000 displays jurisdictions 1014 within a region 1012. By expanding a jurisdiction 1014, other jurisdictions within the Metro Area region are displayed 1016. The hierarchy of agencies and vehicles (not shown) of an outside jurisdiction 1016 can be browsed by expanding the outside jurisdiction. A checkbox is located next to each outside jurisdiction, agency, and vehicle with in the hierarchy of each outside jurisdiction listed. Outside jurisdictions, agencies, and/or vehicles are selected for mutual aid by selecting the appropriate checkbox (es). It will be appreciated that mutual aid need not be reciprocal. For example, jurisdiction A may select jurisdiction B as a mutual aid jurisdiction, whereas jurisdiction A need not be selected for mutual aid within jurisdiction B. As a result, agencies and vehicles of jurisdiction B would be authorized to preempt traffic control in jurisdiction A, but agencies and vehicles of jurisdiction A would not be authorized to preempt traffic control in jurisdiction B.

Figure 11:
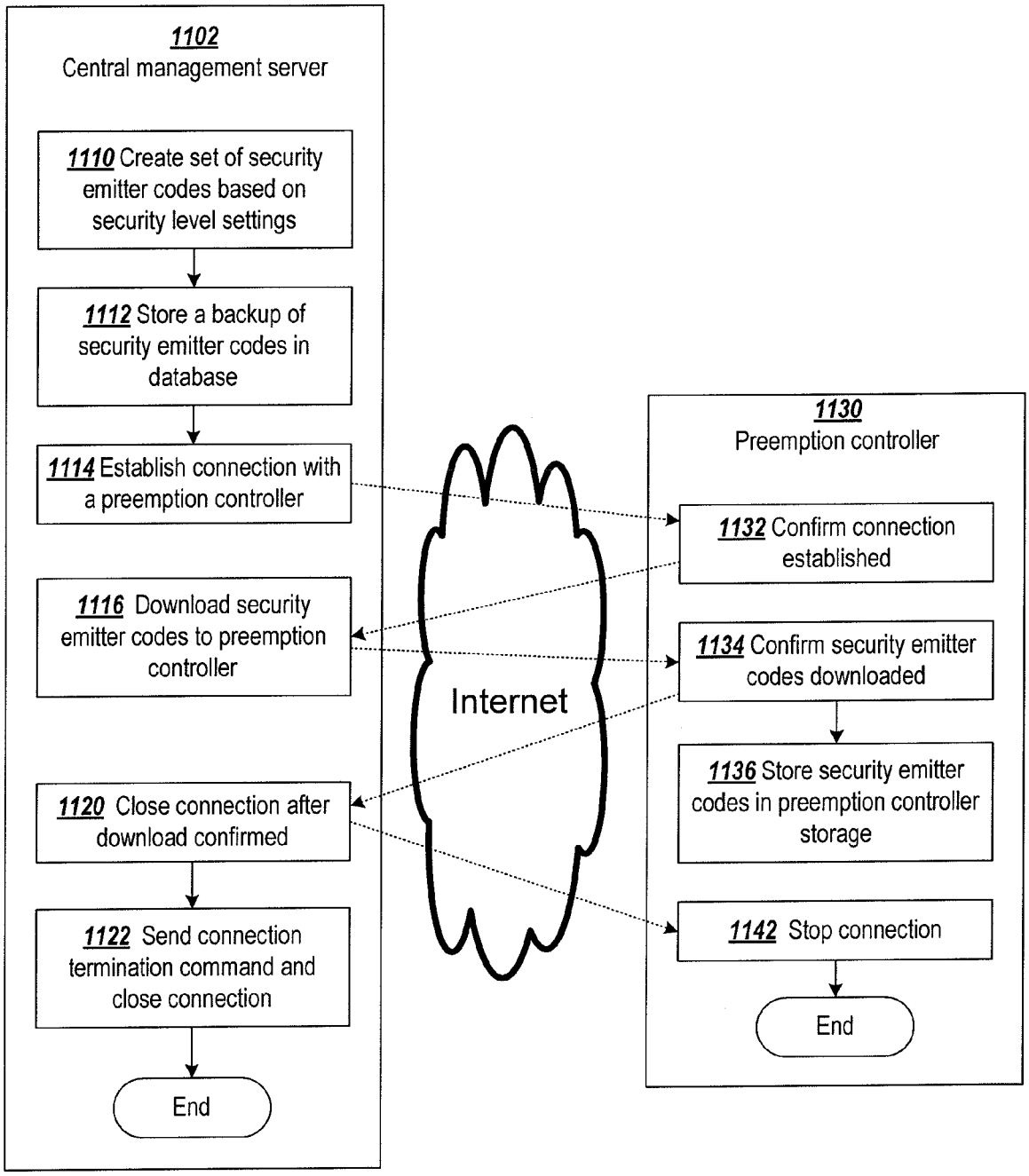
FIG. 11 illustrates, as an example, a flowchart of a process for remote configuration of a preemption controller.

FIG. 11 illustrates, as an example, a flowchart of a process for remote configuration of a preemption controller. A set of emitter codes is created at step 1110 on the central management server 1102 based on security level settings as shown in FIGS. 5 and 6. The central management server stores the security emitter codes in a database at step 1112. The central management server establishes a connection with the preemption controller to be updated 1130 at step 1114. The preemption controller responds by confirming the connection at step 1132. It is understood that establishment and maintenance of the connection include various data exchanges dependent on the communication protocol implemented. The central management server 1102 downloads the security emitter codes to the preemption controller 1130 at step 1116. Once successfully received, the preemption controller 1130 confirms that security codes were downloaded successfully at step 1134 and stores the security emitter codes in preemption controller storage at step 1136.

When the central management server receives the confirmation that security emitter codes were successfully downloaded, the central management server sends a command to terminate the connection and closes the connection at step 1120. When the preemption controller receives the termination command, the preemption controller stops the connection at step 1142 and ends the process on the controller side.

Those skilled in the art will appreciate that various alternative computing arrangements, including one or more processors and a memory arrangement configured with program code, can be configured to perform the processes of the different embodiments of the present invention.

Figure 12:
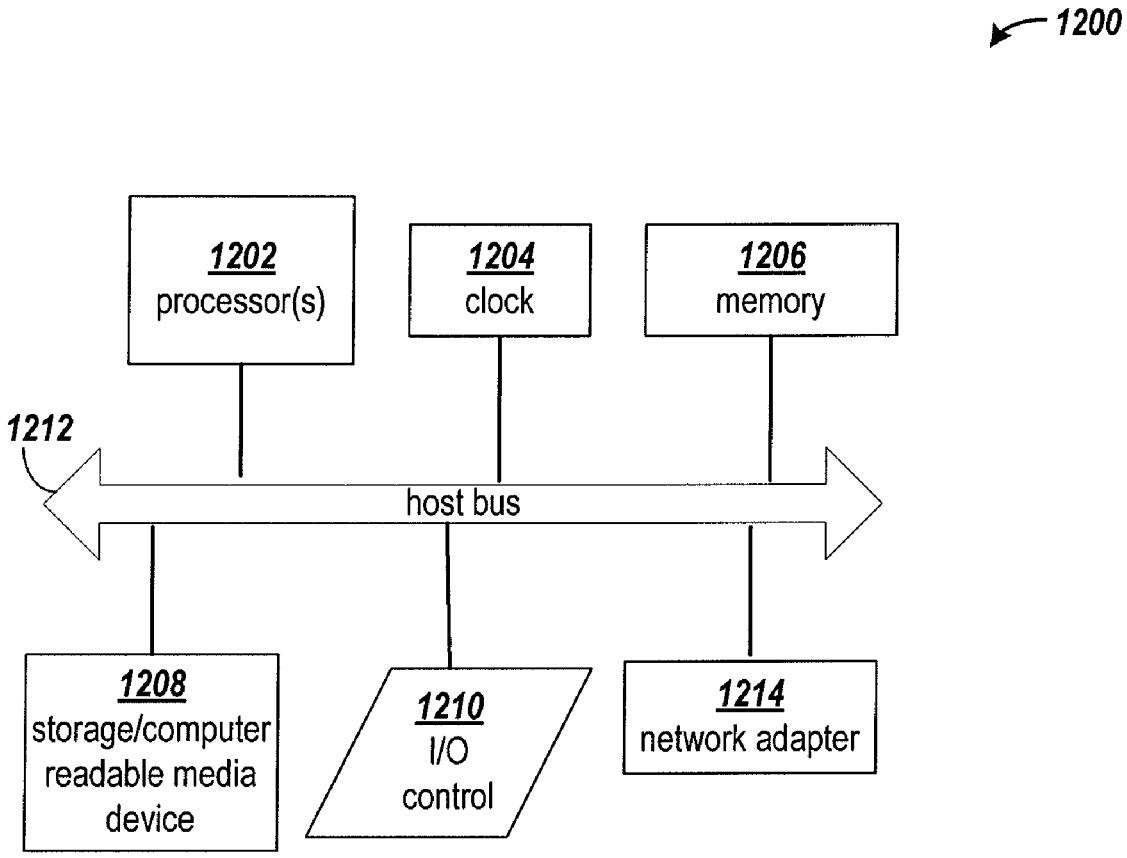
FIG. 12 is a block diagram of an example computing arrangement which can be configured to implement the processes performed by the preemption controller and the central management server described herein.

FIG. 12 is a block diagram of an example computing arrangement which can be configured to implement the processes performed by the preemption controller and central systems server described herein. Those skilled in the art will appreciate that various alternative computing arrangements, including one or more processors and a memory arrangement configured with program code, would be suitable for hosting the processes and data structures and implementing the algorithms of the different embodiments of the present invention. The computer code, comprising the processes of the present invention encoded in a processor executable format, may be stored and provided via a variety of computer-readable storage media or delivery channels such as magnetic or optical disks or tapes, electronic storage devices, or as application services over a network.

Processor computing arrangement 1200 includes one or more processors 1202, a clock signal generator 1204, a memory unit 1206, a storage unit 1208, a network adapter 1214, and an input/output control unit 1210 coupled to host bus 1212. The arrangement 1200 may be implemented with separate components on a circuit board or may be implemented internally within an integrated circuit. When implemented internally within an integrated circuit, the processor computing arrangement is otherwise known as a microcontroller.

The architecture of the computing arrangement depends on implementation requirements as would be recognized by those skilled in the art. The processor 1202 may be one or more general purpose processors, or a combination of one or more general purpose processors and suitable co-processors, or one or more specialized processors (e.g., RISC, CISC, pipelined, etc.).

The memory arrangement 1206 typically includes multiple levels of cache memory and a main memory. The storage arrangement 1208 may include local and/or remote persistent storage such as provided by magnetic disks (not shown), flash, EPROM, or other non-volatile data storage. The storage unit may be read or read/write capable. Further, the memory 1206 and storage 1208 may be combined in a single arrangement.

The processor arrangement 1202 executes the software in storage 1208 and/or memory 1206 arrangements, reads data from and stores data to the storage 1208 and/or memory 1206 arrangements, and communicates with external devices through the input/output control arrangement 1210 and network adapter 1214. These functions are synchronized by the clock signal generator 1204. The resource of the computing arrangement may be managed by either an operating system (not shown), or a hardware control unit (not shown).

The present invention is thought to be applicable to a variety of systems for a preemption controller. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for managing traffic signal preemption at a plurality of intersections, comprising:

inputting a security level code that specifies one of a plurality of security levels for at least one jurisdiction, wherein the one security level controls which emitter codes are allowed to preempt traffic signals at the intersections in the jurisdiction;

determining a set of emitter codes for the plurality of intersections in the jurisdiction in response to the security level code; and downloading the set of emitter codes to a plurality of preemption controllers at the plurality of intersections in the jurisdiction, wherein each preemption controller accepts a preemption request only if the preemption request contains an emitter code indicated by the downloaded set of emitter codes as being allowed to preempt traffic signals at the intersections in the jurisdiction.

2. The method of claim 1, wherein:

the preemption requests for preempting traffic signals are issued from devices on vehicles; and the security levels include a first security level that permits any value of emitter code received in a preemption request to activate preemption, and a second security level that permits any value of emitter code, other than a value signifying that the requesting device is not coded or is coded with a default emitter code, to activate preemption.

3. The method of claim 2, wherein the security levels include a third security level that blocks a preemption request from preempting a traffic signal in response to the preemption request having a value of emitter code signifying that the requesting device is not coded with an emitter code or a value of emitter code signifying that the requesting device is coded with a default emitter code.

4. The method of claim 3, further comprising:

wherein the jurisdiction includes two or more agencies;

assigning respective, non-overlapping ranges of emitter codes to each of the agencies in response to user input; and wherein the security levels include a fourth security level that permits preemption of a traffic signal at an intersection in the jurisdiction only for a preemption request having a value of emitter code within one of the respective non-overlapping ranges of emitter codes.

5. The method of claim 4, further comprising:

storing, in response to user input, respective vehicle identifiers in association with emitter codes; and wherein the security levels include a fifth security level that denies preemption of a traffic signal at an intersection in the jurisdiction for a preemption request having a value of emitter code not associated with a vehicle identifier.

6. The method of claim 4, further comprising:

storing, in response to user input, data indicative of a blocked emitter code in association with the jurisdiction; and wherein the determined set of emitter codes indicates that the blocked emitter code is blocked from preempting traffic signals in the jurisdiction in each of the first, second, third, and fourth security levels.

7. The method of claim 1, further comprising:

storing, in response to user input, data indicative of a blocked emitter code in association with the jurisdiction; and wherein the determined set of emitter codes indicates that the blocked emitter code is blocked from preempting traffic signals in the jurisdiction.

8. The method of claim 1, further comprising:

inputting respective security level codes for two or more jurisdictions;

determining respective sets of emitter codes for the two or more jurisdictions; and downloading each respective set of emitter codes to preemption controllers at intersections in the respective jurisdiction of the two or more jurisdictions.

9. The method of claim 8, wherein the respective security level codes for at least two of the two or more jurisdictions are different and indicate different security levels.

10. The method of claim 8, further comprising:

storing, in response to user input, data indicative of a first and a second one of the two or more jurisdictions providing mutual aid to one another; and wherein the set of emitter codes for the first jurisdiction, includes a subset of emitter codes for the second jurisdiction in response to the data indicative of the mutual aid.

11. The method of claim 10, wherein the set of emitter codes for the second jurisdiction, includes a subset of emitter codes for the first jurisdiction in response to the data indicative of the mutual aid.

12. The method of claim 1 further comprising:

inputting user selection data indicating whether emitter codes corresponding to an agency within the jurisdiction are allowed to preempt traffic signals at the intersections in the jurisdiction; and wherein the set of emitter codes for the plurality of intersections in the jurisdiction is determined from the security level code and the user selection data corresponding to the agency.

13. The method of claim 12 further comprising:

inputting user selection data indicating whether a selected emitter code is allowed to preempt traffic signals at the intersections in the jurisdiction; and wherein the set of emitter codes for the plurality of intersections in the jurisdiction is determined from the security level code, the user selection data corresponding to the agency, and the user selection data corresponding to the selected emitter code.

14. The method of claim 12, further comprising:

inputting user selection data indicating whether a selected emitter code is allowed to preempt traffic signals at the intersections in the jurisdiction; and wherein the set of emitter codes for the plurality of intersections in the jurisdiction is determined from the security level code and the user selection data corresponding to the selected emitter code.

15. A system for managing traffic signal preemption at a plurality of intersections, comprising:

a processor;

a common bus coupled to the processor;

a memory unit coupled to the common bus;

a network adapter; and an input/output unit coupled to the common bus;

wherein, the processor, memory unit, network adapter, and input/output unit are configured to:

receive a security level code input that specifies one of a plurality of security levels for at least one jurisdiction, wherein the security level code input controls which emitter codes are allowed to preempt traffic signals at the plurality of intersections in the jurisdiction;

determine a set of emitter codes for the plurality of intersections in the jurisdiction in response to the security level code; and download the set of emitter codes to a plurality of preemption controllers at the plurality of intersections in the jurisdiction, wherein each preemption controller accepts a preemption request only if the preemption request contains an emitter code indicated by the downloaded set of emitter codes as being allowed to preempt traffic signals at the plurality of intersections in the jurisdiction.

16. The system of claim 15, wherein:

the preemption requests for preempting traffic signals are issued from devices on vehicles; and the security levels include a first security level that permits any value of emitter code received in a preemption request to activate preemption, and a second security level that permits any value of emitter code, other than a value signifying that the requesting device is not coded or is coded with a default emitter code, to activate preemption.

17. The system of claim 16, wherein the security levels include a third security level that blocks a preemption request from preempting a traffic signal in response to the preemption request having a value of emitter code signifying that the requesting device is not coded with an emitter code or a value of emitter code signifying that the requesting device is coded with a default emitter code.

18. The system of claim 15, wherein, the processor and memory unit are configured to:

store data indicative of a first and a second one of the at least one jurisdiction providing mutual aid to one another in response to user input; and wherein the set of determined emitter codes for the first jurisdiction includes a subset of emitter codes for the second jurisdiction in response to the data indicative of the mutual aid.

19. An article of manufacture, comprising:

a non-transitory processor-readable storage medium configured with processor-executable instructions, the instructions when executed by a processor causing the processor to perform operations including:

receiving a security level code input that specifies one of a plurality of security levels for at least one jurisdiction, wherein the one security level input controls which emitter codes are allowed to preempt traffic signals at a plurality of intersections in the jurisdiction;

determining a set of emitter codes for the plurality of intersections in the jurisdiction in response to the security level code; and downloading the set of emitter codes to a plurality of preemption controllers at the plurality of intersections in the jurisdiction, wherein each preemption controller accepts a preemption request only if the preemption request contains an emitter code indicated by the downloaded set of emitter codes as being allowed to preempt traffic signals at the plurality of intersections in the jurisdiction.

20. The article of manufacture of claim 19, wherein the security levels include a security level that blocks a preemption request from preempting a traffic signal in response to the preemption request having a value of emitter code signifying that a requesting device is not coded with an emitter code or a value of emitter code signifying that the requesting device is coded with a default emitter code.

21. The article of manufacture of claim 19, wherein the instructions further cause the processor to:

in response to a user input, store data indicative of a first and a second one of the at least one jurisdiction providing mutual aid to one another; and add to the determined set of emitter codes for the first jurisdiction, a subset of emitter codes for the second jurisdiction, in response to the data indicative of the mutual aid.

* * * * *

UNITED STATES PATENT AND TRADEMARK OFFICE

CERTIFICATE OF CORRECTION

PATENT NO. : 8,325,062 B2
APPLICATION NO. : 12/576623
DATED : December 4, 2012
INVENTOR(S) : Johnson It is certified that error appears in the above-identified patent and that said Letters Patent is hereby corrected as shown below:

In the Specification

Col. 1, line 48: "pulse" should read --pulses--.

Col. 2, line 39: "Opticom" should read --OPTICOM®--.

Col. 4, line 51: "receiver circuit" should read --preemption controller--.

Col. 8, line 62: "Vehicles" should read --Vehicle--.

Col. 9, line 46: "with in" should read --within--.

Col. 9, line 67: "include" should read --includes--.

Col. 10, line 10: "loaded" should read --loaded at step 1120--.

Col. 10, line 12: "1120" should read --1122--.

Signed and Sealed this
Sixteenth Day of July, 2013

Teresa Stanek Rea

Teresa Stanek Rea
*Acting Director of the United States Patent and Trademark Office*